United States Patent [19]

Baysinger

[11] 3,963,410

[45] June 15, 1976

[54] CONTROL SYSTEM FOR DOMESTIC GAS OVEN BURNERS

[75] Inventor: Robert L. Baysinger, St. Louis, Mo.

[73] Assignee: Emerson Electric Co., St. Louis, Mo.

[22] Filed: Mar. 20, 1975

[21] Appl. No.: 560,126

[52] U.S. Cl. ..... 431/46; 431/59; 236/15 A

[51] Int. Cl.[2] ..... F23Q 9/14

[58] Field of Search ..... 236/15 A, 75, 78 R; 431/25, 43, 45, 46, 47, 59

[56] References Cited

UNITED STATES PATENTS

| | | | |
|---|---|---|---|
| 3,443,752 | 5/1969 | Walbridge | 236/75 |
| 3,445,173 | 5/1969 | Malavasi et al. | 431/25 |
| 3,574,496 | 7/1969 | Hewitt | 431/25 |
| 3,902,839 | 9/1975 | Matthews | 431/46 |

FOREIGN PATENTS OR APPLICATIONS

| | | | |
|---|---|---|---|
| 608,408 | 11/1960 | Canada | 431/46 |

*Primary Examiner*—Carroll B. Dority, Jr.
*Attorney, Agent, or Firm*—Charles E. Markham

[57] ABSTRACT

An oven burner control system having a manual rotary valve controlling gas flow to main and pilot burners and a solenoid operated valve controlling flow to the main burner, control circuit means embodying spark ignition means to ignite the pilot, means responsive to conduction through pilot flame to cut off spark ignition and permit operation of the solenoid valve, and variable resistance means responsive to oven temperature effecting cyclic operation of the solenoid valve. A control knob rotating with the manual valve varies the control point of said temperature variable resistance means and actuates a line switch to connect and disconnect the control circuit with a power source.

14 Claims, 4 Drawing Figures

CONTROL SYSTEM FOR DOMESTIC GAS OVEN BURNERS

This invention relates generally to control systems for fluid fuel burners and particularly to electrically operated ignition and control means for domestic gas oven burners.

The primary object of the invention is to provide a generally new and particularly safe reliable electrical control system for domestic gas range oven burners which is economical to construct.

A further object is to provide a control system of this kind having a pilot burner which is burning only when the oven is in use.

A further object is to provide a control system of this kind having particularly economical temperature variable resistance means for cyclically operating the main burner in a manner to maintain various selected oven temperatures.

A further object is to provide a control system for domestic gas range oven burners having control circuit means for cyclically operating a main burner fuel valve including oven temperature responsive switching means and pilot flame conduction responsive switching means employing solid state amplifiers and switches, which control circuit is constructed so as to preclude opening of the main burner valve in event of faulty component conduction or a faulty signal indicating pilot flame when it does not exist.

Further objects and advantages will appear from the following description when read in connection with the accompanying drawing.

DESCRIPTION OF VALVE

Figures 1, 2, 3, 4:
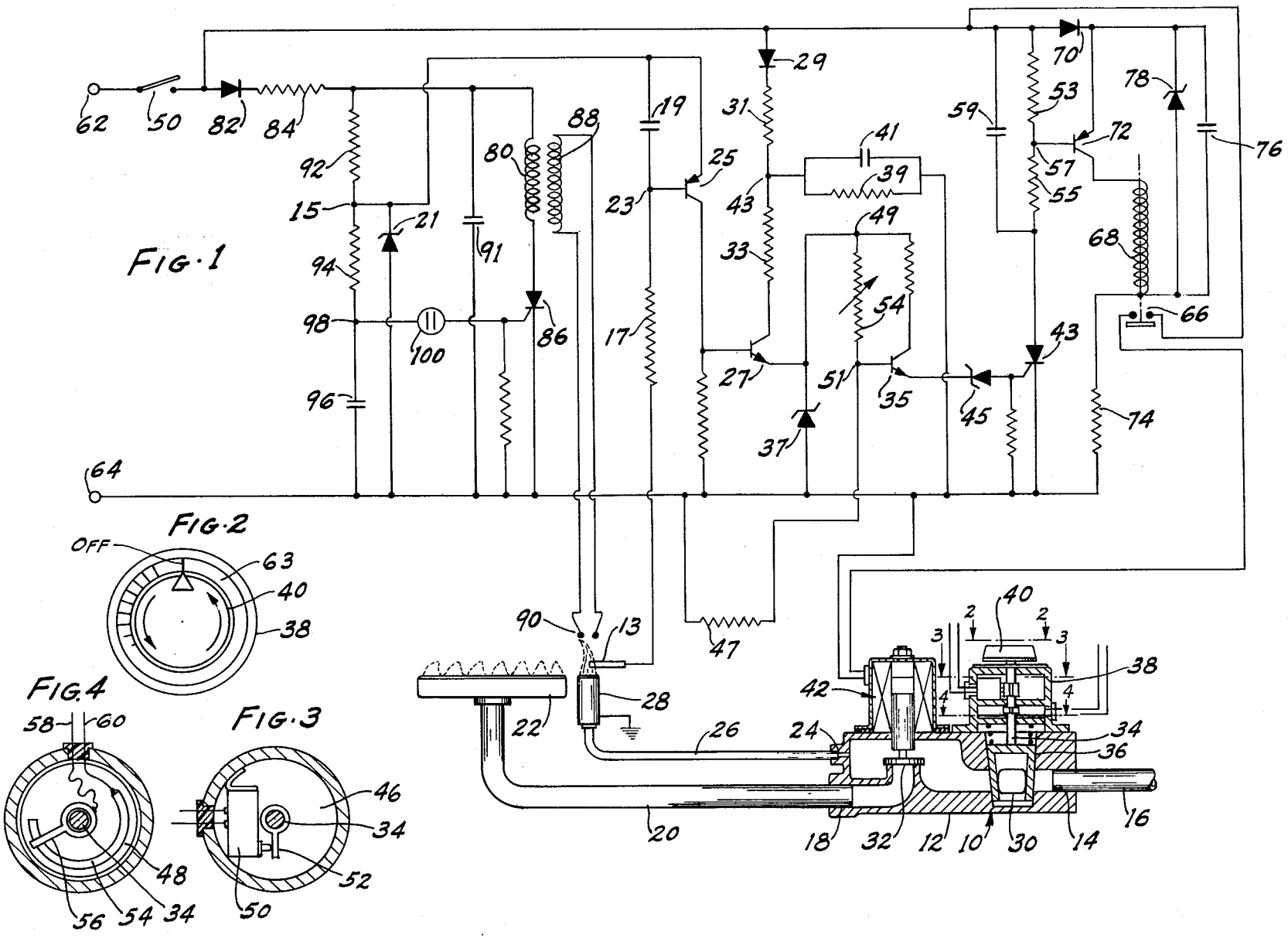
FIG. 1 is a schematic illustration of an ignition and control system constructed in accordance with the invention, shown in connection with main and pilot burners.
FIG. 2 is a top plan view of the manual control knob taken along line 2—2 of FIG. 1.
FIG. 3 is a cross-sectional view taken along line 3—3 of FIG. 1.
FIG. 4 is a cross-sectional view taken along line 4—4 of FIG. 1.

Referring to FIG. 1, a manifold valve device generally indicated at 10 has a body member 12. Body 12 has an inlet 14 receiving a gas supply conduit 16, a main burner outlet 18 receiving a conduit 20 leading to a main burner 22, and a pilot burner outlet 24 receiving a conduit 26 leading to a pilot burner 28. Passageway means in body 12 connects inlet 14 with outlet 16, and gas flow therethrough is controlled by a hollow, tapered, rotary plug valve 30 and a series-arranged, solenoid operated main burner valve 32. The pilot burner 28 is constructed of conductive material and is grounded for a purpose to be described.

The tapered plug valve 30 is fitted in a tapered bore 36 in body 12 and includes a stem 34 extending upwardly through a cylindrical casing 38 mounted on body member 12 and connected to a manual control knob 40. The main burner valve 32 is normally closed on its seat and is opened when a solenoid, generally indicated at 42, is energized The cylindrical casing 38 mounted on body member 12 is divided into upper and lower chambers 46 and 48, see FIGS. 3 and 4. Mounted in upper chamber 46, see FIG. 3, is a normally closed microswitch 50 which is held in open circuit breaking position by an arm 52 attached to rotary valve stem 34 when the rotary plug valve 30 and control knob 40 are in closed position.

Referring to FIG. 4, a manually variable resistance element 54 is arranged to be swept by a contact arm 56 attached to and insulated from valve stem 34. The contact arm 56 is shown in the position it assumes when rotary plug valve 30 and control knob 40 are in closed position. As control knob 40 is rotated counterclockwise from this position to open plug valve 30, the microswitch 50 is permitted to close. Also, counterclockwise rotation of the control knob progressively reduces the resistance between leads 58 and 60 connected to the ends of resistance element 54.

SPARK IGNITION CIRCUIT

The spark ignition circuit comprises a voltage step-up transformer having a primary winding 80 connected across a pair of a.c. power source terminals 62 and 64 through line switch 50, a diode 82, a resistor 84, and an SCR 86 and a secondary winding 88 across which a pair of spaced spark electrodes 90 are connected. The spark electrodes 90 are positioned adjacent pilot burner 28 to effect its ignition. The spark ignition circuit further includes a storage capacitor 91 connected in parallel with primary winding 80 and SCR 86. The storage capacitor 91 charges through resistor 84 and diode 82 over a number of cycles of the a.c. power supply to a voltage determined by a gating circuit for SCR 86. When SCR 86 conducts capacitor 91 discharges through primary winding 80 to induce a high voltage across secondary winding 88 and effect a spark across electrodes 90.

The gating circuit for SCR 86 comprises a resistor 94 and a capacitor 96, connected in series across the a.c. power source terminals 62–64, through switch 50, diode 82, resistor 84 and resistor 92. A gate lead connected to a point 98 between resistor 94 and capacitor 96 and to the control electrode of SCR 86 includes a neon bulb 100. Capacitor 96 charges to the threshold voltage of neon bulb 100 over a number of cycles of the power source, and when this occurs, a neon bulb 100 fires and gates SCR 86 to conduct. Preferably, the time constants are such that the discharge of the capacitor 91 to produce a spark occurs in the order of twice per second when operating on a 60-cycle, a.c. power source.

There is a flame probe 13 positioned adjacent the pilot burner 28 so as to be enveloped by pilot flame. The flame probe 13 is connected to a point 15 between resistors 92 and 94, through a resistor 17, and a capacitor 19. A Zener diode 21 connected between point 15 and power source terminal 64 provides a means of maintaining a reference voltage at point 15. When flame exists at pilot burner 28, the impedance between probe 13 and ground through the flame and metal pilot burner decreases to effect a voltage drop at a point 23 between resistor 17 and capacitor 19, which is connected to the base of a PNP transistor 25. As a result, transistor 25 conducts and the voltage at point 15 falls below that which is required to effect the charging of capacitor 96 to the threshold voltage of triggering neon bulb 100. Operation of the spark igniter is therefore cut off.

SOLENOID VALVE CONTROL CIRCUIT

The solenoid 42 is connected across the a. c. power source terminals 62–64 through switch 50 and the normally open contacts 66 of a relay having a winding 68. Relay winding 68 is connected across the power source terminals through switch 50, diode 70, a PNP transistor 72, and a resistor 74. There is a storage capacitor 76 connected in parallel with transistor 72 and relay winding 68. Capacitor 76 is charged through resistor 74 and diode 70 and attains a predetermined charge through a number of cycles of the power source. The predetermined charge attained by storage capacitor 76 is determined by a parallel-connected Zener diode 78.

Referring again to the PNP resistor 25, which is biased to conduction when probe 13 is grounded through pilot flame, the emitter of transistor 25 is connected to point 15, and its collector is connected to the base of an NPN transistor 27 which receives a plus signal to effect its conduction when transistor 25 conducts. The collector of transistor 27 is connected to power source terminal 62 through switch 50, a diode 29, and resistors 31 and 33, and its emitter is connected to the collector of an NPN transistor 35. The emitter of transistor 27 is also connected to power source terminal 64 through a Zener diode 37 which is operative to limit the output voltage of transistor 27 to a predetermined value. There is also a voltage dropping means comprising a resistor 39 and a capacitor 41 connected in parallel between a point 43 and the power source terminal 64. The emitter of transistor 35 is connected to the control electrode of an SCR 43 through a Zener diode 45.

The manually variable resistor 54 is connected in series with a thermistor 47 between a point 49 in the gating circuit of SCR 43 and the power source terminal 64. The termistor 47, having a negative coefficient of resistance, is positioned so as to respond to the temperature variations in an oven heated by main burner 22. The base of transistor 35 is connected to a point 51 between manually variable resistor 54 and thermistor 47. In this arrangement, an increase in resistance of thermistor 47 relative to a manually adjusted resistance of resistor 54 results in forwardly biasing transistor 35. When transistor 35 is forwardly biased sufficiently, a threshold voltage is applied to Zener diode 45 and a firing signal is applied to SCR 43.

SCR 43 has its anode side connected to power source terminal 62 through switch 50 and series arranged resistors 53 and 55 and its anode side connected directly to terminal 64. The base of PNP transistor 72 is connected to a point 57 between resistors 53 and 55, and when SCR 43 conducts, the transistor 72 is biased to conduct. When transistor 72 conducts, the storage capacitor 76, which has been charged over a number of cycles of the power supply, now discharges through a low impedance loop including only transistor 72 and relay winding 68. The energy of this capacitor discharge together with that which is supplied by line voltage and limited by resistor 74 sufficiently energizes winding 68 to pull relay contacts 66 closed.

Following the initial discharge of capacitor 76 and the closing of relay contacts 66, the SCR 43 continues to conduct every other half cycle of the power supply. A capacitor 59 connected across resistors 53 and 55 functions to maintain the forward bias of transistor 72 during the non-conductive half cycles of SCR 43. Also, following its initial discharge, storage capacitor 76 will be charged to a much lower voltage each conductive half cycle of diode 70, determined by the impedance of parallel relay winding 68 and the resistance of series connected resistor 74, and will discharge the following half cycle through the low impedance loop including relay winding 68 during the non-conductive half cycles. The charge acquired in capacitor 76 during one half cycle under this condition is considerably less than that required to effect closure of relay contacts 66 upon its discharge, but is sufficient to hold the relay closed and prevent chattering during the half cycles in which transistor 72 is not conducting through diode 70.

OPERATION OF THE SYSTEM

The system is shown in an inoperative condition, with the control knob 40 in an off position, with line switch 50 open, and the manual rotary valve 30 and solenoid operated valve 32 closed. When it is desired to heat and maintain the oven at a preselected temperature, the knob 40 is turned clockwise to a selected oven temperature, as indicated on an indicia plate. An initial counterclockwise movement of knob 40 permits line switch 50 to close and cause the rotary plug valve 30 to be opened. The wall of hollow plug valve 30 is ported so that it is open sufficiently to permit adequate gas flow to the pilot and main burners when knob 40 is rotated counterclockwise an amount to effect closing of line switch 50.

Fuel now flows to the pilot burner 28 and sparking occurs at electrodes 90 to ignite it. When pilot flame occurs probe 13 is grounded through the pilot flame, causing a sufficient drop at point 15 to effect conduction of transistor 25. Conduction through transistor 25 and through the pilot flame lowers the voltage at point 15 below that required to charge capacitor 96 to the threshold voltage of neon-bulb 100. Sparking of electrodes 90 therefore ceases.

Upon closure of line switch 50, storage capacitor 76 of the valve control circuit will charge concurrently with capacitor 91 of the igniter circuit and will attain a predetermined charge, determined by parallel-connected Zener diode 78, before igniter capacitor 91 charges to the threshold voltage of neon bulb 100.

When the pilot burner is ignited and transistor 25 conducts as a result of the grounding of probe 13 through pilot flame, a forward biasing voltage is applied to the base of transistor 27, causing it to conduct. If at this time the oven is cold or below some preselected temperature setting of the control knob corresponding to an adjusted resistance of the manually adjustable resistor 54, the resistance of thermistor 47 will be sufficient relative to resistor 54 to result in sufficient voltage at point 51 to cause transistor 35 to conduct and apply a firing signal to the electrode of SCR 43 through the Zener diode 45.

When SCR 43 conducts, the voltage at point 57 drops causing transistor 72 to conduct and storage capacitor 76 to discharge through winding 68, causing closure of relay contacts 66. Closure of contacts 66 causes solenoid valve 32 to open and fuel to be supplied to main burner 22 where it is ignited by pilot flame. Following the discharge of capacitor 76 and closure of contacts 66, energization of relay winding 68 is maintained at a "hold in" but not a "pull in" level so long as the voltage at point 51 is sufficient to effect firing of SCR 43.

When the oven temperature increases above the setting of knob 40 as a result of burner operation, the resistance of thermistor 47 drops, causing a voltage drop at point 51 below that capable of applying a firing signal to SCR 43 via transistor 35 and Zener diode 45. When this occurs, relay contacts 66 open and solenoid operated valve 32 closes, cutting off main burner operation. When the oven temperature now falls below the setting of knob 40, the resistance of thermistor 47 will again increase to the point wherein the voltage at 51 will increase sufficiently to fire SCR 43. During the period the main burner is off, storage capacitor 76 again charges sufficiently to effect closing of contacts 66 when transistor 72 becomes conductive. The main burner will in this manner by cycled on and off to maintain a selected oven temperature.

In order to discontinue operation of the main and pilot burners, the control knob is turned clockwise to off position. This action positively cuts off all fuel flow to the main and pilot burners and opens line switch 50 to disconnect the ignition and control system from he power source.

If the probe 13 is inadvertently grounded by any means at the time line switch 50 is closed, the main burner valve will not be opened. Under these conditions, the transistor 72 will become conductive immediately upon closure of switch 50, thereby precluding the sufficient charging of storage capacitor 76 required to effect closure of relay contacts 66. Moreover, faulty conduction of transistor 72 or SCR 43, or any of the transistors effective to gate the SCR 43, would also result in conduction through winding 68 immediately upon closure of line switch 50 and prevent the accumulation of the required charge on capacitor 76.

I claim:

1. In a burner control system,
a pilot burner,
a main burner,
an electrical power source,
electrically operated means operative when energized to cause fuel to be supplied to said main burner,
circuit means including controlled solid state switching means connecting said electrically operated means across said power source,
a gating circuit for said switching means connecting one side of said power source to the controlling electrode of said switching means,
said gating circuit including first and second controlled solid state switching means,
circuit means responsive to the existence of pilot flame operative to effect conduction of said first switching means, and
temperature responsive circuit means operative to effect on and off conduction of said second switching means,
said temperature responsive means comprising:
temperature variable resistance means responsive to change in ambient temperature of a space heated by said main burner,
circuit means connecting said resistance means across said power source and including means operative to apply a predetermined voltage across said resistance means, and
means connecting the control electrode of said second switching means to one side of said resistance means.

2. The control system claimed in claim 1 in which said circuit means connecting said variable resistance means across said power source includes a manually variable resistance means operative to selectively apply predetermined voltages across said temperature variable resistance means.

3. The control circuit claimed in claim 1 in which means responsive to the existence of pilot flame comprises spaced electrodes arranged to be enveloped by pilot flame connected between one side of said power source and ground, and amplifying means responsive to flame conduction between said electrodes operative to apply a signal voltage to the electrode of said first switching means to effect its conduction.

4. The control system claimed in claim 1 which further includes a manually operable rotary valve controlling the flow of fuel to said main burner, and means rotating with said valve operative to vary the voltage across said temperature variable resistance means.

5. The control system claimed in claim 1 further including a manually operable rotary valve controlling the flow of fuel to both main and pilot burners, and electrically operated ignition means operative to ignite said pilot burner.

6. The control system claimed in claim 5 including a line switch operative to connect and disconnect the entire system with said power source, and means rotating with said rotary valve operative to actuate said line switch.

7. In a control system for gas oven burners,
a source of a.c. electrical power,
a pilot burner,
a main burner,
a manually operable rotary valve controlling gas flow to both burners,
a main valve controlling gas flow to said main burner,
electromagnetically operated means controlling operation of said main valve including an electromagnetic winding,
electrically operated ignition means operative to ignite said pilot burner,
circuit means connecting said electromagnetic winding across said power source including a diode, a controlled solid state switching means, and a resistor,
said resistor being operative to limit the energization of said electromagnetic winding when said switching means is conducting to a level sufficient to maintain said main valve open but insufficient to effect the opening thereof,
means responsive to flame at said pilot burner operative to effect conduction of said switching means,
a storage capacitor connected in parallel with said electromagnetic winding and said switching means and in series with said resistor and said diode,
said storage capacitor being operative to attain a sufficient charge in a predetermined time during which said switching means is not conducting to effect, upon its discharge through said parallel connected electromagnetic winding, sufficient energization thereof to cause the opening of said main valve,
said storage capacitor being prevented from attaining a charge sufficient to cause opening of said main valve when said switching means is conducting,
a line switch operative to connect and disconnect said system from said power source, and
means moving with said rotary valve operative to acutate said line switch.

8. The control system claimed in claim 7 which further includes means responsive to directional changes in oven temperature operative to effect conduction and non-conduction of said switching means.

9. In an electrically operated control system for gas oven burners,
a source of electrical power, a pilot burner,
a main burner,
a manual valve controlling gas flow to both burners,
an electrically operated main valve controlling gas flow to said main burner,
electrical ignition means for igniting said pilot burner,
control circuit means controlling operation of said electrically operated main valve including switching means responsive to pilot flame and temperature responsive switching means responsive to oven temperature changes,
adjusting means for said temperature responsive switching means operative to vary the temperature point at which said temperature responsive switching means responds,
a line switch for connecting and disconnecting the system with said power source,
means movable with said manual valve for actuating said line switch, and
means operatively connecting said adjusting means with said manual valve.

10. The control system claimed in claim 9 in which said switching means responsive to pilot flame compreses a controlled solid state switching means, spaced electrodes arranged to be enveloped by pilot flame, circuit means operative to apply a predetermined voltage across said electrodes, and amplifying means responsive to conduction across said electrodes through pilot flame operative to apply a signal voltage to the control electrode of said switching means to effect its conduction.

11. The control system claimed in claim 9 which further includes means responsive to pilot flame operative to cut off operation of said electrical ignition means.

12. In a control system for fluid fuel burners,
a source of electrical power,
a pilot burner,
a main burner,
a manually operable valve controlling fuel to both burners,
a main valve controlling fuel flow to said main burner,
electromagnetically operated means controlling operation of said main valve including an electromagnetic winding,
electrically operated ignition means operative to ignite said pilot burner,
circuit means connecting said electromagnetic winding across said power source including a controlled solid state switching means and a resistor,
said resistor being operative to limit energization of said electromagnetic winding to a level sufficient to maintain said main valve open but insufficient to effect the opening thereof,
means responsive to flame at said pilot burner operative to effect conduction of said switching means, a storage capacitor connected in parallel with said electromagnetic winding and said switching means and in series with said resistor,
said storage capacitor being operative to attain a sufficient charge in a predetermined time during which said switching means is not conducting to effect, upon discharge thereof through said parallel connected electromagnetic winding, a sufficient energization of said winding to cause the opening of said main valve,
said storage capacitor being prevented from attaining a sufficient charge to cause the opening of said main valve when said switching means is conducting,
a line switch operative to connect and disconnect said system from said power source, and
means moving with said manually operable valve operative to actuate line switch.

13. In a control system for fluid fuel burners,
a pilot burner,
a main burner,
a first valve controlling fuel flow to both burners,
a second valve controlling fuel flow to said main burner,
electrically operated means controlling operation of said second valve,
circuit means including first controlled solid state switching means operative when conducting to connect said electrically operated means across said power source,
spark ignition means operative to ignite said pilot burner,
said spark ignition means including storage capacitor means operative upon discharge thereof to provide a spark producing pulse and second controlled solid state switching means controlling discharge of said storage capacitor,
resistance-capacitance circuit means operative to periodically gate said second switching means to effect discharge of said storage capacitor,
gating circuit means for said first switching means including spaced electrodes arranged to be bridged by pilot flame and operative when pilot flame exists to effect conduction of said first switching means, and
shunting circuit means connecting said spaced electrodes in parallel with said resistance capacitance circuit means and operative when pilot flame exists to render said resistance capacitance circuit means inoperative to gate said second switching means.

14. The control system claimed in claim 13 in which said gating circuit means for said first switching means includes circuit means connected in parallel with said resistance capacitance circuit means operative to shunt said resistance capacitance circuit means operative in parallel with said resistance capacitance circuit means operative to shunt said resistance capacitance circuit and prevent gating of said second switching means.

* * * * *